US006197396B1

(12) United States Patent
Haas et al.

(10) Patent No.: US 6,197,396 B1
(45) Date of Patent: Mar. 6, 2001

(54) IDENTIFICATION CARD STRIP ASSEMBLY

(75) Inventors: David J. Haas; Sandra Haas, both of Suffern, NY (US); Inna Shames, Montclair, NJ (US); Jody P. Sherman, New City, NY (US)

(73) Assignee: Temtec, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/241,133

(22) Filed: Feb. 1, 1999

Related U.S. Application Data

(63) Continuation of application No. 08/866,939, filed on May 31, 1997, now abandoned, which is a continuation of application No. 29/065,241, filed on Jan. 27, 1996, now abandoned, which is a continuation of application No. 29/065, 242, filed on Jan. 27, 1996, now Pat. No. Des. 394,675, which is a continuation of application No. 29/063,584, filed on Dec. 4, 1996, now Pat. No. Des. 386,793.

(51) Int. Cl.[7] ..... B42D 15/10; G09F 3/14

(52) U.S. Cl. ..... 428/40.1; 40/1.5; 283/81; 428/42.1; 428/42.2; 428/43; 428/136; 428/137

(58) Field of Search ..... 428/40.1, 42.2, 428/42.1, 43, 136, 137; 40/1.5; 283/81

(56) References Cited

U.S. PATENT DOCUMENTS 5,172,938 * 12/1992 Schmidt ..... 283/109
5,700,037 * 12/1997 Keller ..... 283/107

* cited by examiner

*Primary Examiner*—Nasser Ahmad
(74) *Attorney, Agent, or Firm*—Michael Zall

(57) ABSTRACT

An identification card strip assembly including a support strip having thereon at least one, and preferably a plurality of identification card blanks removably and adhesively adhered to the support strip. Each identification card blank has a front printing surface for printing indicia thereon and a rear adhesive surface having an adhesive thereon. The rear adhesive surface is removably and adhesively adhered to the support strip. The card blank includes a first sheet and a second sheet foldably connected to each other along a fold line. Each sheet has at least one substantially identically shaped aperture therein. Each of the sheets is of a size and shape and the aperture is located in each sheet so that when the card blank is removed from the support strip and the sheets are folded along the fold line upon each other with the adhesive surfaces joined to each other, the first sheet and second sheets are substantially superimposed upon each other and substantially coextensive with each other and the apertures in each sheet overlay each other to form a mounting means for mounting the card on an object. Alternatively, each sheet has at least one substantially identically shaped aperture area therein in the shape of an aperture, the aperture area being defined by a continuous slit in the sheet and being severable from the sheet along the slit. Each aperture area is located in each sheet so that when the card blank is removed from the support strip and the sheets are folded along the fold line upon each other with the adhesive surfaces joined to each other, the aperture areas in each sheet are substantially superimposed upon each other and substantially coextensive. The aperture areas may then be removed from the sheets by severing along the slits to form a mounting means for mounting the card on an object.

In preferred embodiments, the identification cards are uniquely and symmetrically shaped about the fold line so that when the card blank is removed from the support strip and the sheets are folded along the fold line upon each other with the adhesive surfaces joined to each other, the unique shapes are substantially superimposed upon each other and substantially coextensive to form a predetermined non-rectangular configuration, e.g., computer monitor, house, automobile, etc. that is relevant, for example, to the conference or meeting.

The process for producing the identification cards comprises printing indicia on the printing surface of at least one of the first and second sheets of each card blank, removing the card blank from the support strip, folding the first and second sheets along the fold line upon each other with the adhesive surfaces joined to each other. The card may then be mounted on an object.

6 Claims, 15 Drawing Sheets

IDENTIFICATION CARD STRIP ASSEMBLY

RELATED APPLICATIONS

This is a continuing application of U.S. Ser. No. 08/866,939 filed on May 31, 1997 now abandoned (3.0-027) entitled IDENTIFICATION CARD STRIP ASSEMBLY, which is a continuing application of U.S. Ser. Nos. 29/063,584, filed on Dec. 04, 1996, (3.1-010) now U.S. Pat. No. Des. 386,793 29/065,241, (3.1-012) and 29/065,242 (3.1-011) filed on Jan. 27, 1997 now U.S. Pat. No. Des. 394,675, all of which are entitled CARD BADGE. The entire disclosures of these design patent applications are incorporated herein by reference.

FIELD OF THE INVENTION

This invention relates to cards and badges for identification and security and specifically to thin paper or cardboard badges which can be easily manufactured, preferably in unique configurations, printed and written upon, and distributed using computerized equipment to provide the capability of customizing printing, color, content and speed of delivery at low costs.

BACKGROUND OF THE INVENTION

A primary disadvantage of known identification cards is that they are generally stiff and relatively thick and cannot pass through, for example, a laser printer. At meetings, conventions and seminars it has become desirable to place large amounts of data on a card, including bar codes, names, company name and address, etc. Further, identification cards that are made of plastic are not "environmentally friendly," they will not biodegrade. To date there has not been an effective system available. Additionally, it is desirable for certain type functions to have an identification card that not only has such data thereon but also is uniquely shaped to emphasize the type function for which the card is being used.

U.S. Pat. Nos. 4,454,180; 4,547,252; and 4,648,930 to La Mers disclose a labeling system employing an elongated label strip used with motor driven sprocket rollers for sequentially delivering labels to a mechanism operable to apply each label to an object. These patents describe a carrier web consisting of a series of labels with viscous pressure sensitive adhesive applied to a carrier strip of paper which has been coated on the label side with a release agent. The labels are removed by moving them sequentially by pulling the carrier strip around a relatively sharp edge under tension. The label, because of its stiffness, releases from the carrier web and continues in a straight line over the edge rather than bend sharply and follow the carrier web. The labels shown in the La Mers patents are mounted on a carrier which employs a center line cut therein to facilitate the rapid and accurate removal of labels.

U.S. Pat. No. 4,925,716 to Haas describes a computerized processing of identification badges employing a base carrier portion in the form of a web carrier. The web carrier has perforated end portions formed integrally therewith so that the sprockets of automated computerized printing equipment can be used to engage the carrier web. The carrier web also is formed into sections via a lateral perforation so that each section is removable, one from the other. The badges are each removably adhesively mounted on individual ones of the sections. The badge may be peeled away from the carrier web without any adhesive remaining on the badge. The badge employed is relatively stiff, being formed of plastic material, and has an elongated slot formed on the upper central portion thereof so that the badge can be affixed to the person via a spring clip.

U.S. Pat. No. 5,139,836 to Burke describes a tag assembly wherein the tag sheet is cut to provide a plurality of discrete tags which may be removed from the carrier sheet. Burke requires that the adhesive be applied to a major portion of the carrier sheet and be adapted to be retained on the sheet and not on the tag when the tag is removed so that there is no residue or adhesive remaining on the tags. There is no teaching or suggestion of a double layered card capable of being printed on both sides.

U.S. Pat. No. 5,662,976 to Popat et al describes a three layered card comprising laminations surrounding a card having only one surface for printing thereon. Additionally, there is no provision for attaching the card to a person's clothing. There is no teaching or suggestion of a double layered card capable of being printed on both sides.

U.S. Pat. No. 5,172,938 to Schmidt describes a breast pocket ID card. There is no provision for providing a double layered laminated card that can be printed upon on both sides and mounted on a clip for attachment to clothing.

U.S. Pat. No. 5,700,037 to Keller describes a foldable semirigid plastic card made of polyvinylchloride that can not be printed upon with a laser printer, i.e., it is semirigid. Additionally, the layers are not adhered to each other by an adhesive.

There are numerous other patents relating to identification cards and badges, methods of producing them, and their use. See, for example, the following U.S. Patents:

| | |
|---|---|
| 2,395,804 to DeGruchy | 767,647 to Bree |
| 3,175,317 to Slavsky | 4,790,566 to Boissier |
| 3,996,679 to Warneke | 4,869,941 to Ohki |
| 4,020,575 to Kruger et al | 4,999,065 to Wilfert |
| 4,170,015 to Elliano et al | 5,019,421 to Mecke et al |
| 4,222,662 to Kruegle | 5,106,719 to Oshikoshi et al |
| 4,305,215 to Smith | 5,157,424 to Craven et al |
| 4,579,754 to Maurer et al | 5,161,826 to Van Giesen et al |
| 4,596,409 to Holbein | 5,219,610 to Koshizuka et al |
| 4,680,459 to Drexler | 5,270,073 to Koshizuka et al |
| 4,687,526 to Wilfert | 5,380,695 to Chiang et al |
| 4,692,394 to Drexler | 5,421,619 to Dyball |
| 4,695,173 to Tomida | 5,427,832 to Longtin |

None of these references however provide an inexpensive and easy to use alternative to the relatively thick polymeric badges and holders presently used for seminars, corporate meetings, conferences and shows.

OBJECTS AND SUMMARY OF THE INVENTION

An object of this invention is to provide an identification card or badge system which can be easily automated using computer equipment to rapidly imprint badges with computer stored information and to enable the badges to be handled in the same manner as continuous fan fold computer paper.

Another object of this invention is to provide an identification badge or card which can be generated at the location where the same will be used, such as at a trade show.

Yet another object of the invention is to provide an identification card strip assembly wherein the cards can be made of thin paper or cardboard, printed thereon with, for example a laser printer, and then assembled into a sturdy, relatively thick identification card.

A still further object of the invention is to provide a relatively sturdy identification badge which can be easily printed thereon and affixed to the wearer without the use of any adhesive.

Yet another object of this invention is to provide an identification badge with a non-reflective exposed surface such that when the badge is passed through an electronic scanner or reader, e.g., bar code slot reader/scanner, the badge surface can be placed in substantial contact with the reader or scanner without an overlying plastic covering or coating to interfere with the scanner and to thereby provide a more accurate and rapid reading of the badge.

All of the foregoing objects of this invention are achieved by the identification card strip assembly of this invention and the process of using it to produce the identification cards described herein. Broadly, the identification card strip assembly comprises a support strip having thereon at least one, and preferably a plurality of identification card blanks removably and adhesively adhered to the support strip. The assembly is sufficiently flexible to pass through, for example, a laser printer or pin feed printer. Each identification card blank has a front printing surface for printing indicia thereon and a rear adhesive surface having an adhesive thereon. The rear adhesive surface is removably and adhesively adhered to the support strip. The card blank includes a first sheet and a second sheet foldably connected to each other along a fold line. Each sheet has at least one substantially identically shaped aperture therein. Each of the sheets is of a size and shape and the aperture is located in each sheet so that when the card blank is removed from the support strip and the sheets are folded along the fold line upon each other with the adhesive surfaces joined to each other, the first sheet and second sheets are substantially superimposed upon each other and substantially coextensive with each other and the apertures in each sheet overlay each other to form a mounting means for mounting the card on an object.

Alternatively, each sheet has at least one substantially identically shaped aperture area therein in the shape of an aperture, the aperture area being defined by a continuous slit in the sheet and being severable from the sheet along the slit. Each aperture area is located in each sheet so that when the card blank is removed from the support strip and the sheets are folded along the fold line upon each other with the adhesive surfaces joined to each other, the aperture areas in each sheet are substantially superimposed upon each other and substantially coextensive. The aperture areas may then be removed from the sheets by severing along the slits to form a mounting means for mounting the card on an object.

In preferred embodiments, the identification cards are uniquely and symmetrically shaped about the fold line so that when the card blank is removed from the support strip and the sheets are folded along the fold line upon each other with the adhesive surfaces joined to each other, the unique shapes are substantially superimposed upon each other and substantially coextensive to form a predetermined non-rectangular configuration, e.g., computer monitor, house, automobile, etc. that is relevant, for example, to the conference or meeting.

The process for producing the identification cards comprises printing indicia on the printing surface of at least one of the first and second sheets of each card blank, removing the card blank from the support strip, folding the first and second sheets along the fold line upon each other with the adhesive surfaces joined to each other. The card may then be mounted on, for example, a plastic clip that can be attached to the users garment.

These as well as further objects and advantages of the invention will become apparent to those skilled in the art from a review of the following detailed specification, reference being made to the accompanying drawings.

DETAILED DESCRIPTION OF THE INVENTION

Figure 2:
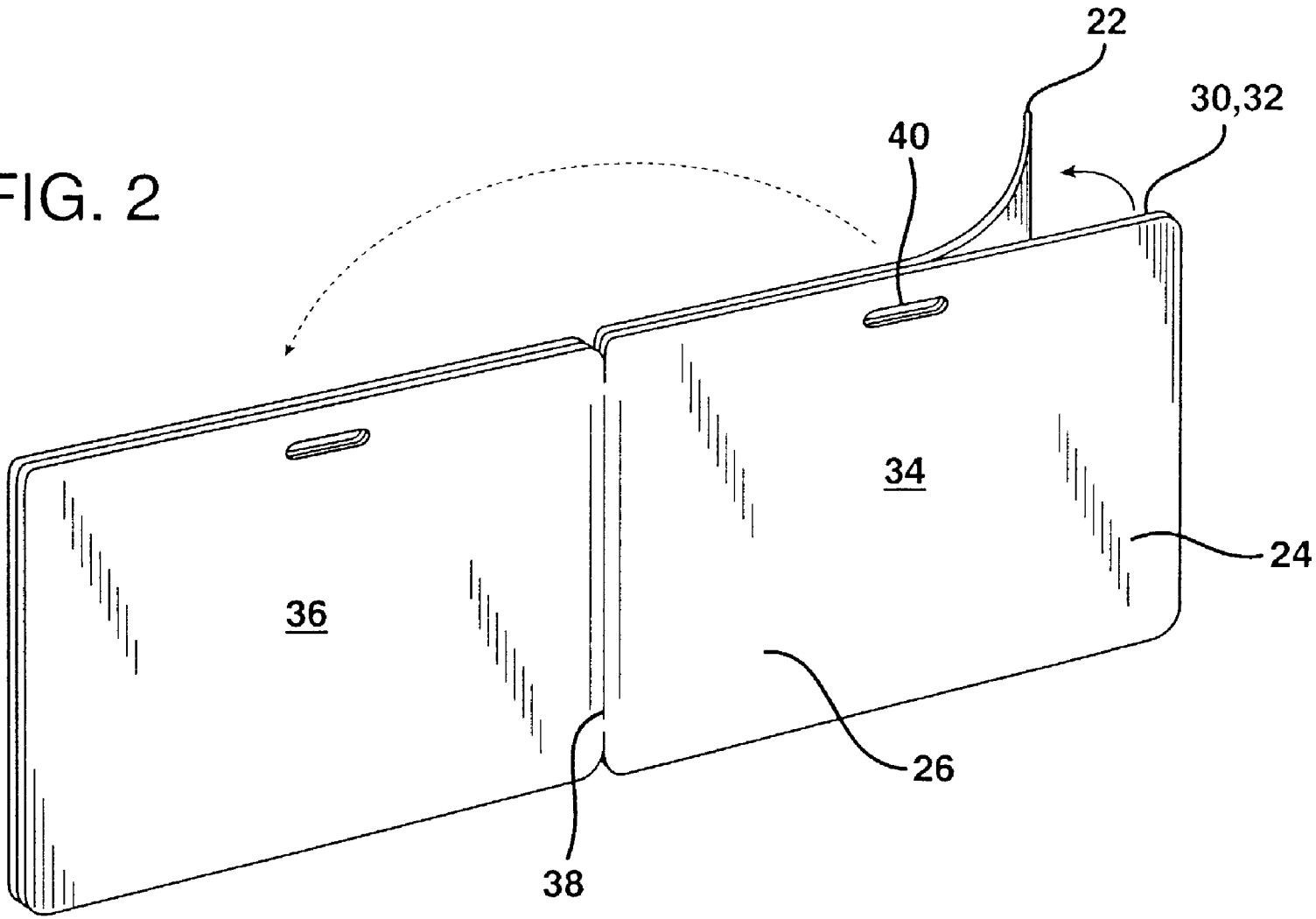
FIG. 2 is a schematic perspective indicating how the identification card of FIG. 1 is assembled.
Figure 6:
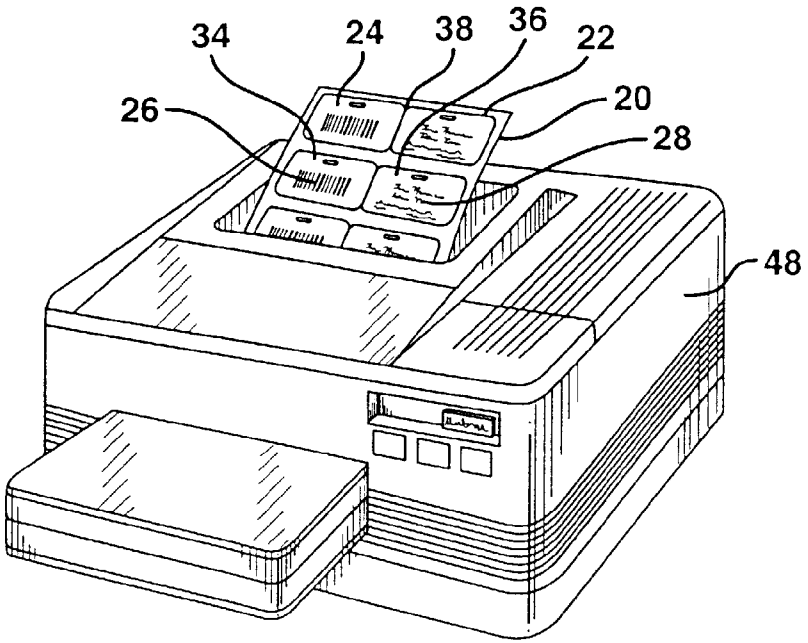
FIG. 6 is schematic view showing another embodiment of a plurality of the card badges of this invention being printed with a laser printer prior to assembly and use.
Figure 5:
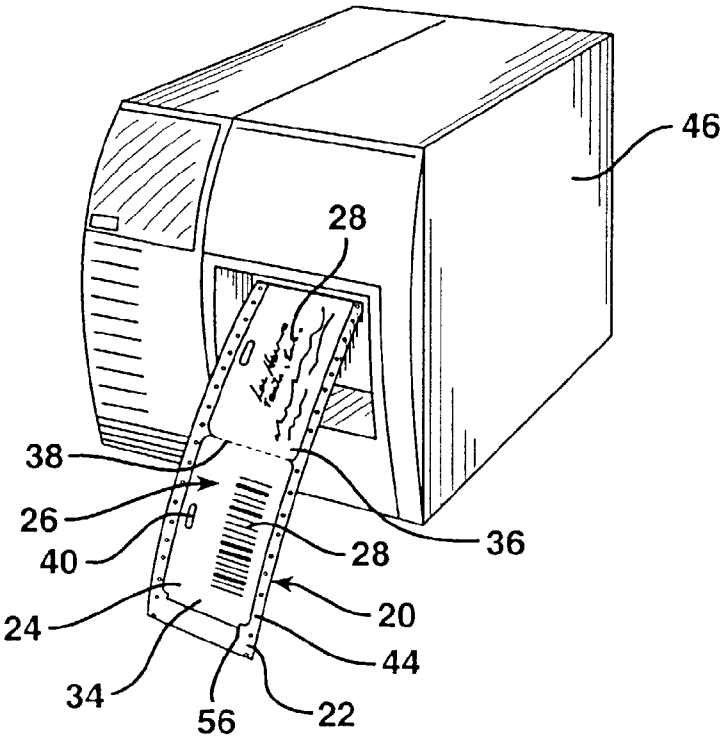
FIG. 5 is schematic view showing one embodiment of a plurality of the card badges of this invention being printed with a Carol-type printer prior to assembly and use.
Figure 7:
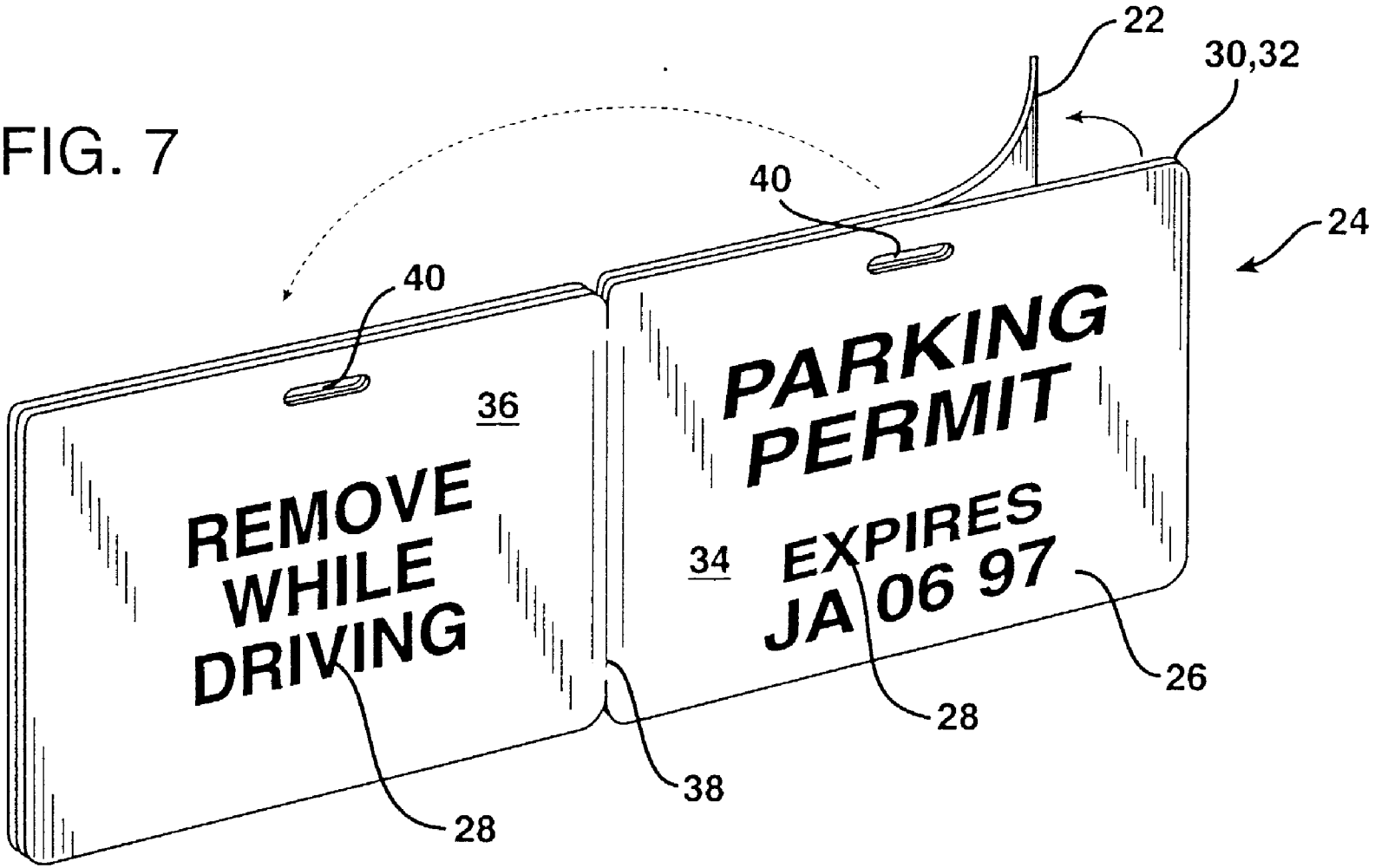
FIG. 7 is a schematic perspective indicating how an embodiment of the parking permit card of this invention is assembled.
Figure 8:
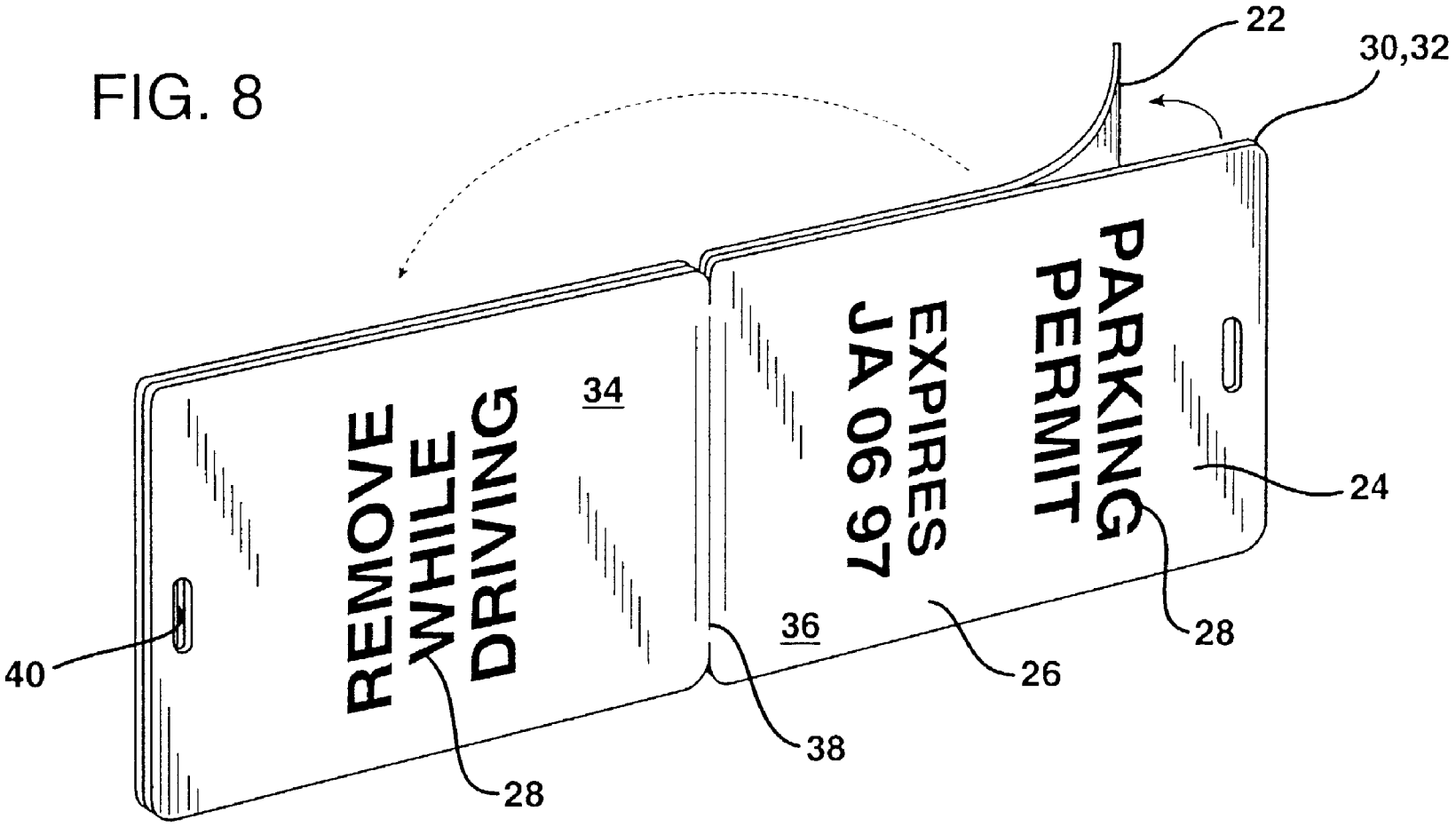
FIG. 8 is a schematic perspective indicating how another embodiment of the parking permit card of this invention is assembled.
Figure 9:
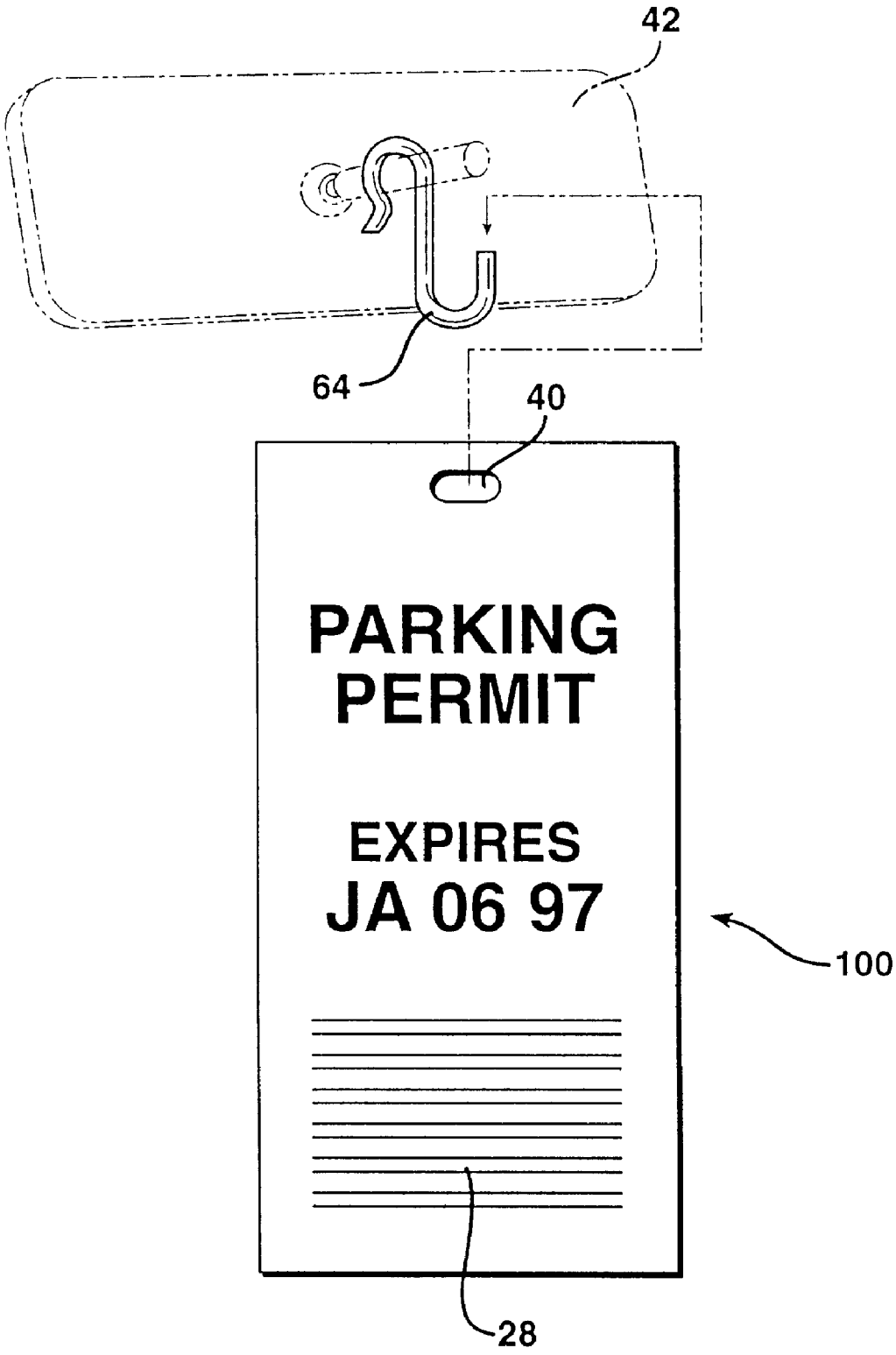
FIG. 9 is a schematic perspective indicating how the assembled parking permit card is placed on a clip to hang on a rear view mirror of a car.

Referring, for example, to FIGS. 2, 5 and 6, an identification card strip assembly 20 is provided. The assembly 20 comprises a support strip 22 having at least one, and preferably a plurality of identification card blanks 24 removably and adhesively adhered to the support strip 22. Preferably, the support strip 22 is an elongated strip 22 as depicted, for example in FIGS. 5, 10, 11 and 13, and may have pin-holes or perforations 44 along the longitudinal edges of the strip 22 to permit driving of the strip through an associated printing device 46, see FIG. 5. A major advantage of this invention is that a standard laser type printer 48, see FIG. 6, may be used to print the identification card blanks 24. If such an embodiment is used then the support strip 22 may be a standard 8½ inch by 11 inch sheet having a plurality of card blanks 24 appropriately arranged. (See, FIG. 6). Optionally, although not shown, the support strip maybe envelope size (#10) and have only one card blank thereon and fed to the printer in a manner similar to an envelope.

Referring, for example, to FIGS. 7–13, each identification card blank 24 has a front printing surface 26 for printing indicia 28 thereon and a rear adhesive surface 30 having an adhesive 32 thereon. The adhesive 32 may partially or completely cover the adhesive surface 30. The rear adhesive surface 30 is removably and adhesively adhered to the support strip 22. The card blank 24 includes a first sheet 34 and a second sheet 36 foldably connected to each other along a fold line 38. Each sheet 34, 36 has at least one substantially identically shaped aperture therein 40. Each sheet 34, 36 is of a size and shape and each aperture 40 is located in each sheet 34,36 so that when the card blank 24 is removed from the support strip 22 and the sheets are folded along the fold line 38 upon each other with the adhesive surfaces 30 joined to each other, the first sheet 34 and second sheet 36 are substantially superimposed upon each other and substantially coextensive with each other and the apertures 40 in each sheet 34, 36 overlay each other to form a mounting means for mounting the card 24 on an object, for example a rear view mirror 42, see FIGS. 9 and 12. The apertures 40 may be located at any appropriate place in the card blank 24, compare, for example, the location of the apertures in FIG . 7 (top) and FIG. 8 (side). Optionally, only one adhesive surface can be coated with an adhesive to join to the other non-coated adhesive surface.

Figure 13:
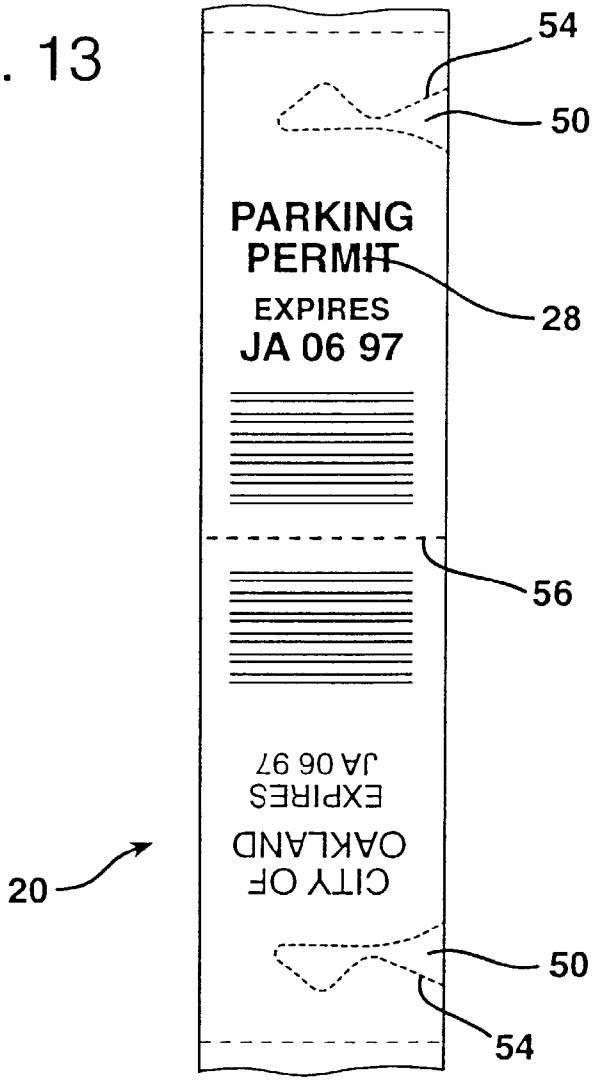
FIG. 13 depicts the printed side of the parking permit card of depicted in FIG. 12 right after printing and prior to assembly.
Figure 12:
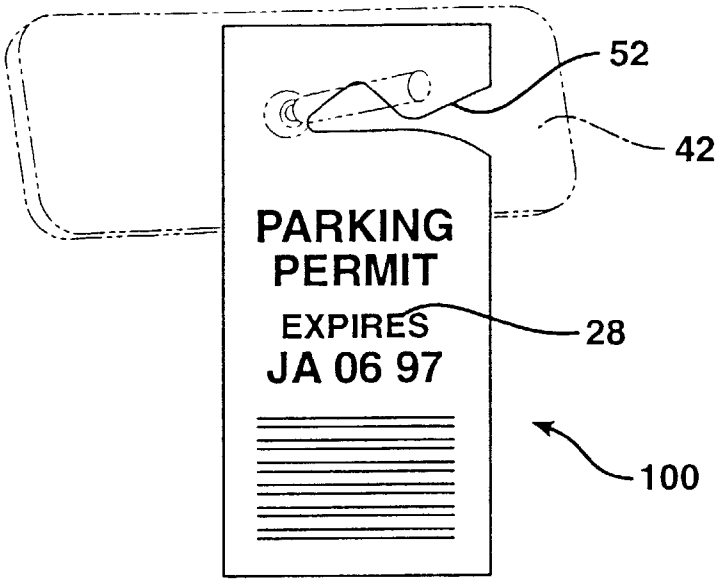
FIG. 12 is a perspective view of an embodiment of another embodiment of assembled parking permit card in use on a rear view mirror of a car.

Referring to FIGS. 12 and 13, optionally each sheet 34,36 may have at least one substantially identically shaped aperture area 50 therein in the shape of an aperture 52, the aperture area 50 being defined by a continuous slit 54 in the sheet and being severable from the sheet 34, 36 along the slit 54. Still referring to FIGS. 12 and 13, each sheet 34, 36 is of a size and shape and each aperture area 50 being located in each sheet 34, 36 so that when the card blank 24 is removed from the support strip 22 and the sheets 34, 36 are folded along the fold line 38 upon each other with the adhesive surfaces 30 joined to each other, the first sheet 34 and second sheet 36 and the aperture areas 52 in each sheet 34, 36 are substantially superimposed upon each other and substantially coextensive. Subsequently, the aperture areas 52 are removed from the sheets 34, 36 by severing along the slits 54 to form a mounting means for mounting the card on an object. As depicted in FIGS. 12 and 13, the aperture 52 may be in the shape of a slot for placement on a rearview mirror 42. This invention, however contemplates any type or shaped aperture.

Figure 10:
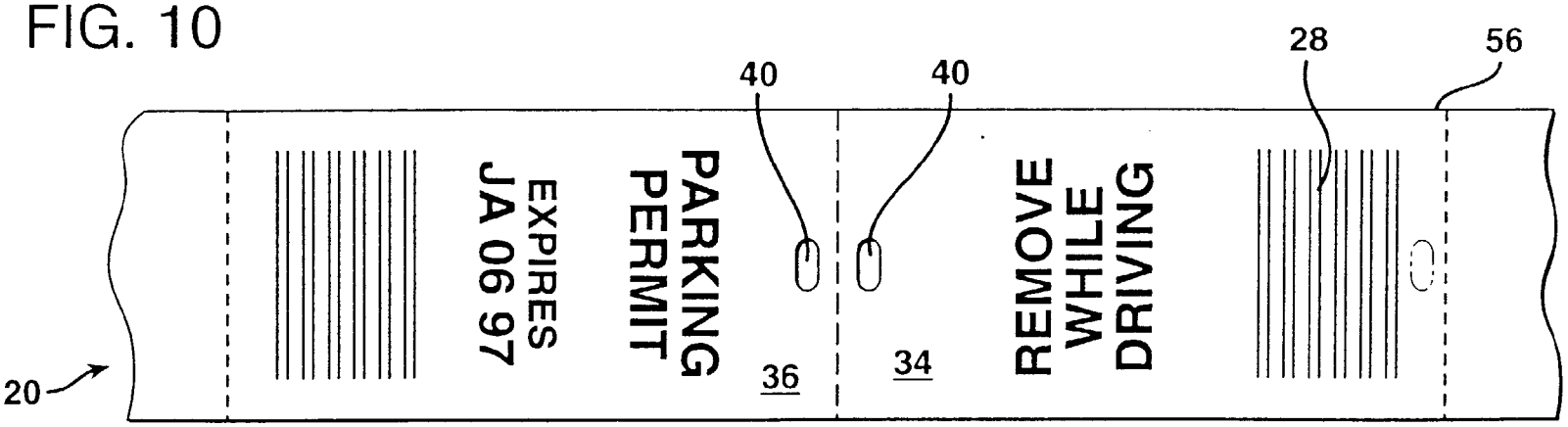
FIG. 10 depicts the printed side of a parking permit card of this invention right after printing and prior to assembly.
Figure 11:
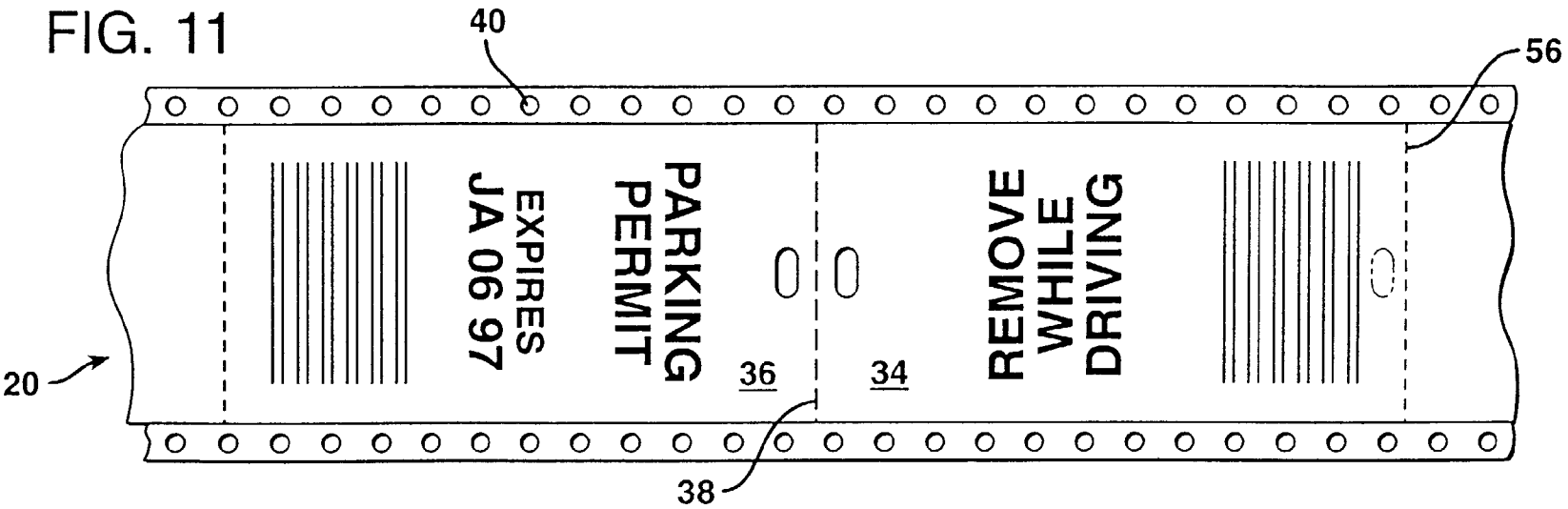
FIG. 11 depicts the printed side of the parking permit card of this invention right after printing on a pin-feed or Carol-type printer and prior to assembly.

Preferably, as depicted in FIGS. 5,10 and 11, the plurality of card blanks 24 are formed from a continuous sheet and defined by plurality of lateral slits 56 extending across the sheet at substantially equal longitudinal intervals. The card blanks 24 are then severable from each other along the slits 56.

Optionally, for assemblies of the type depicted in FIG. 6, the plurality of card blanks 24 may be formed from a continuous sheet and defined by a plurality of lateral slits extending across the sheet at substantially equal longitudinal intervals and a plurality of longitudinal slits extending across the sheet at substantially equal lateral intervals, the card blanks 24 being severable from each other along the slits. The card blanks may also be spaced apart on the support sheet to permit easy peeling therefrom.

The process for producing the plurality of identification cards includes printing indicia 28, for example as shown in FIGS. 5 and 6 on the printing surface 26 of at least one of the first and second sheets 34, 36 of each card blank 26. One of the major advantages of this invention is that both sheets 34, 36 can be printed simultaneously, in effect, printing the front of the badge and the rear of the badge. Subsequently, the card blank 24 is removed from the support strip 22 (see FIGS. 2, 7 and 8) and the first and second sheets 34, 36 folded along the fold line 38 upon each other with the adhesive surfaces 30 joined to each other. This produces an identification card 100 having the first sheet and second sheets 34, 36 substantially superimposed upon each other and substantially coextensive with each other. The apertures in each sheet 34, 36 overlaying each other to form a mounting means for mounting the card on an object. Or optionally, as indicated previously, the identically shaped aperture areas 52 in each sheet 34, 36 are substantially superimposed upon each other and substantially coextensive. Subsequently, the aperture areas 52 are removed from the sheets 34, 36 by severing along the slits 54 to form a mounting means for mounting the card on an object.

The identification card produced 100 is a three layer laminate consisting of two sheets of cardstock having an adhesive layer therebetween that is relatively rigid due to such lamination.

Figure 1:
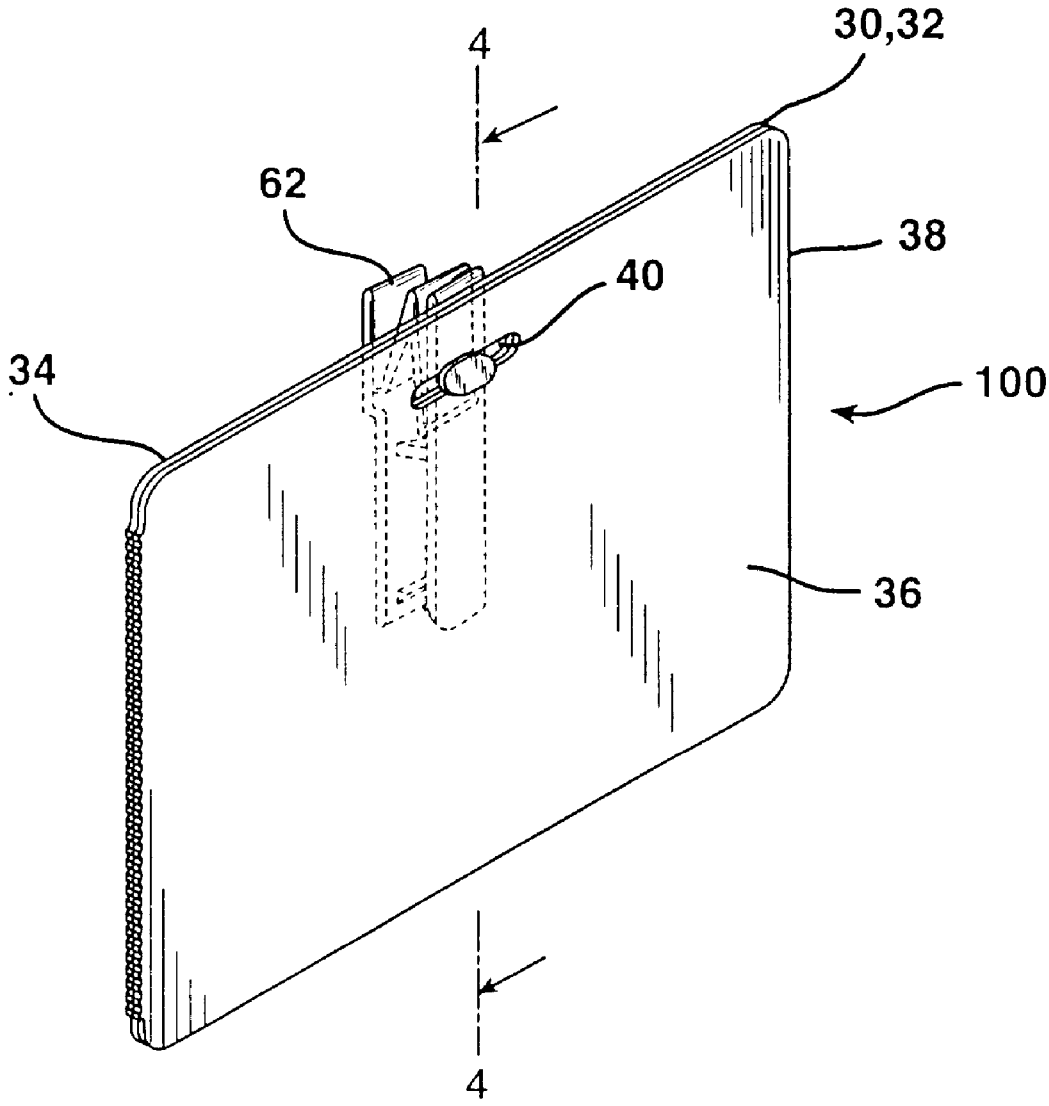
FIG. 1 is a perspective view of an embodiment of the identification card badge of this invention in use.
Figure 3:
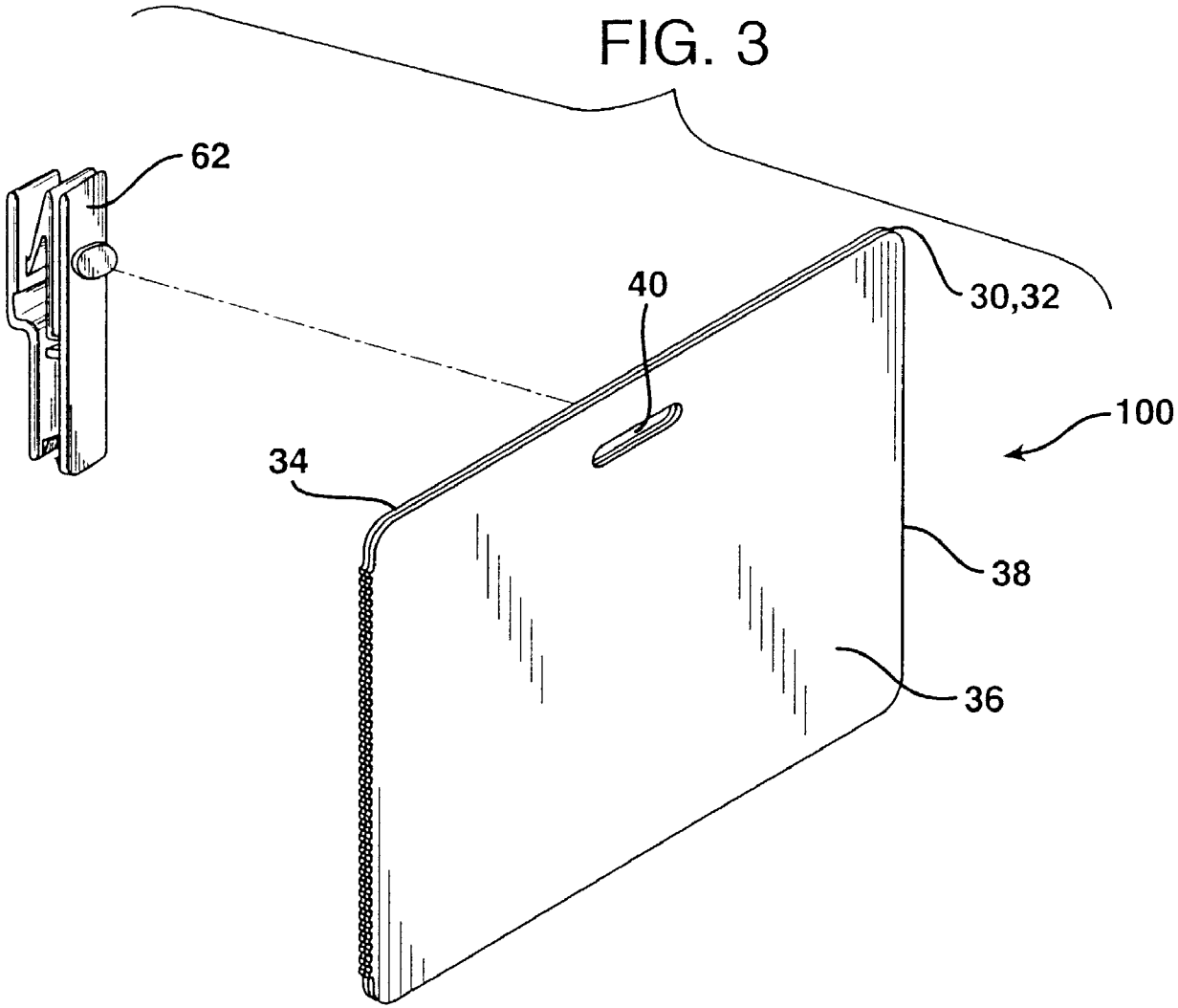
FIG. 3 is a schematic perspective indicating how the assembled card is placed on a badge clip.
Figure 4:
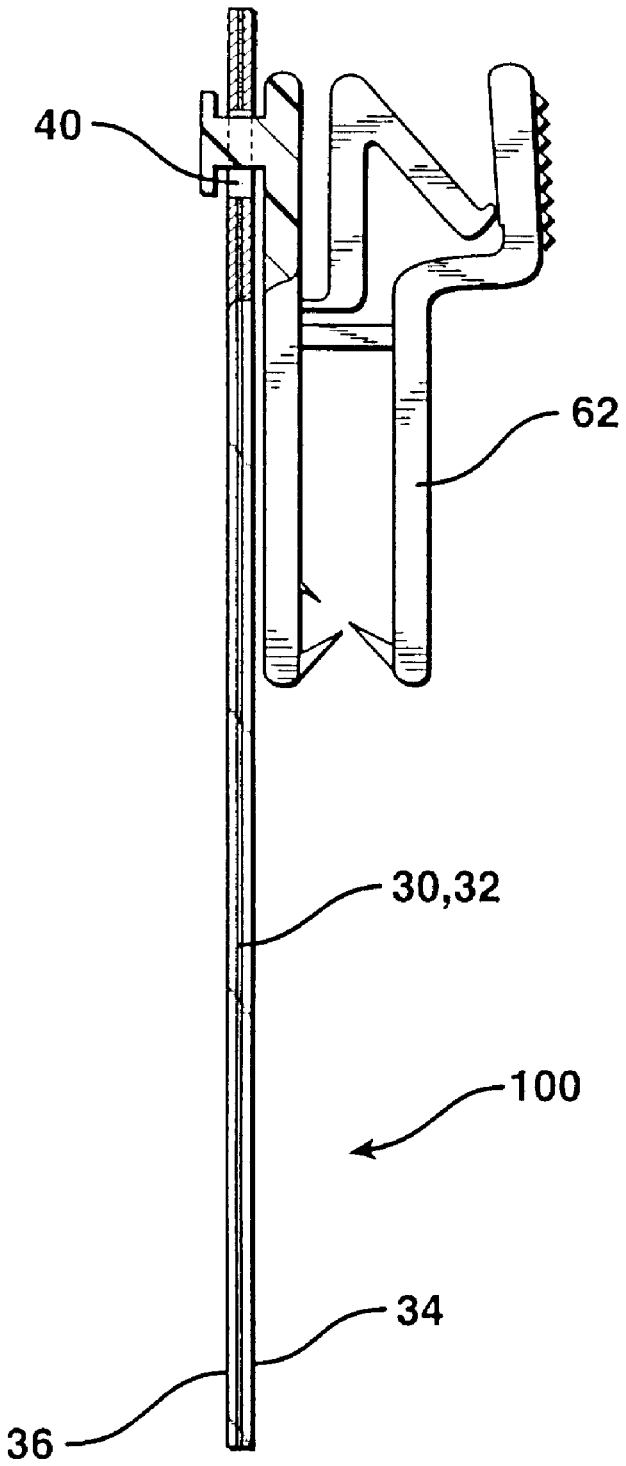
FIG. 4 is a sectional view of the card badge of FIG. 1 taken along line 4—4 of FIG. 1.

Preferably, the assembled identification card 100 is mounted on a spring badge clip 62. See, for example FIGS. 1, 3 and 4. Such clips are known in the art, see for example, U.S. Pat. No. 386,215 (3.1-009) and U.S. Pat. No. 5,640,742 (3.0-021) both to White et al and both entitled "Spring Badge Clip". The entire disclosures of these applications are incorporated by reference. Other type clips may also be used.

This invention has many benefits. For example, in its preferred embodiment, the identification card strip assembly 20 can be used to produce a 2-ply, relatively heavy duty cardstock identification cards 100 that can be custom printed on the back at the same time that you print on the front. Additionally, the identification cards 100 produced are preslotted so that they can be used with clips, e.g., the badge clips of White et al.

In a preferred embodiment of this invention, depicted in FIGS. 7–13, the identification card strip assembly 20 can be used to prepare parking hangtags 100. Parking hangtags 100 are typically made of plastic or very thick cardstock in order to hang vertically and not curl in an automobile (due to heat, humidity, handling). This rigidity also permits easy attachment and removal by means of a large die-cut hook or circle cut-out within the hangtag. Hangtags are almost always attached to the rear view mirror 42 of vehicles and are typically very large, 3"×6" in order to permit them to be seen and read by enforcement officers from a distance of 15 to 25 feet from in front of the vehicle. This rear view mirror attachment is almost universal because it is the only common location near the driver where the hangtag can be attached and removed easily by the driver when parking and driving the vehicle. Additionally, if they are not removed before driving the vehicle because of their large size, they tend to swing and blow-around while the vehicle is in motion, being a distraction to the driver. There are several common problems with conventional parking hangtags. First, because of the difficulty in attaching and removing parking hangtags from the rear view mirror, they are typically left hanging from the rear view mirror during driving. Even though parking hangtags clearly state that they must be removed while driving, this warning is almost universally ignored. Further, almost all hangtags are made of rigid 10 or 20 mil plastic in order to withstand the constant handling and attachment by the office or agency issuing the hangtags and the user. Because such thick materials are used they are not capable of being printed by normal office computer-printers. Typically the expiration date is written on by hand, which makes it easy altered and hence, the hangtags can be altered by changing the expiration date.

Still referring to FIGS. 7–13, the preferred parking hangtag of this invention 100 attaches to a simple plastic hook 64 that is left attached to the rear view mirror 42. When a person is issued a hangtag for either permanent parking or disability parking, the simple plastic hook 64 is attached to the persons rear view mirror 42. Each time the hangtag 100 is to be used, it is attached by means of the aperture or hole 40 in the hangtag, hooked over the rear view mirror 42. When the car is to be driven again, the hangtag 100 is easily removed from the hook 64.

As shown in FIGS. 7–13, the parking hangtag of this invention 100 employs a separate plastic hook 64 that is permanently attached to the rear view mirror 42 and is easy to attach and remove from the mirror. This decreases the possibility of the parking hangtag 100 becoming a hazard while driving. Additionally, the hangtag 100 can be printed on demand by a thermal transfer or a laser printer which eliminates the problem of having to purchase large quantities of hangtags in advance. It also means that the date of expiration can be printed in very large numbers and letters by the electronic printer which will reduce the problem of date-changing. Furthermore, by printing the hangtags on an electronic printer, one can preprint the cardstock economically with all types of secure features such as panagraph, multiple colors, holograms, etc., to make them more secure and harder to counterfeit.

Figure 14:
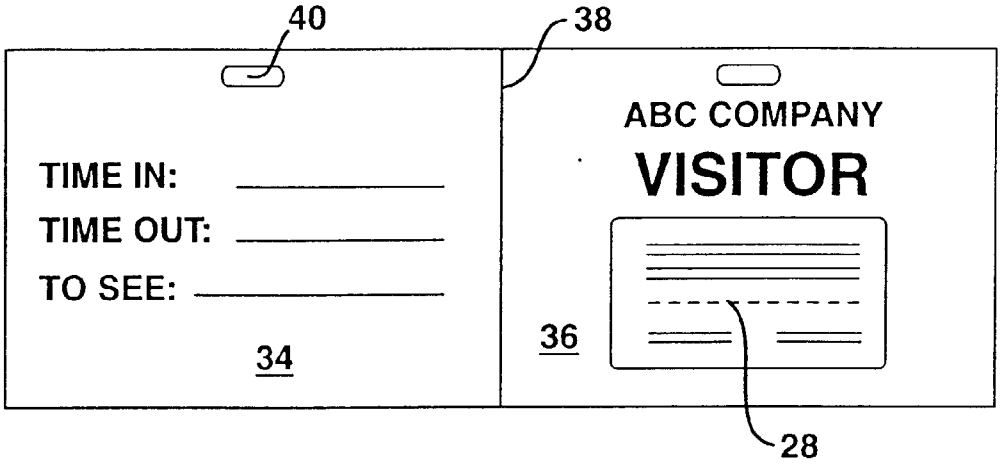
FIG. 14 depicts the printed side of a visitor identification card badge of this invention right after printing and prior to assembly.
Figure 15:
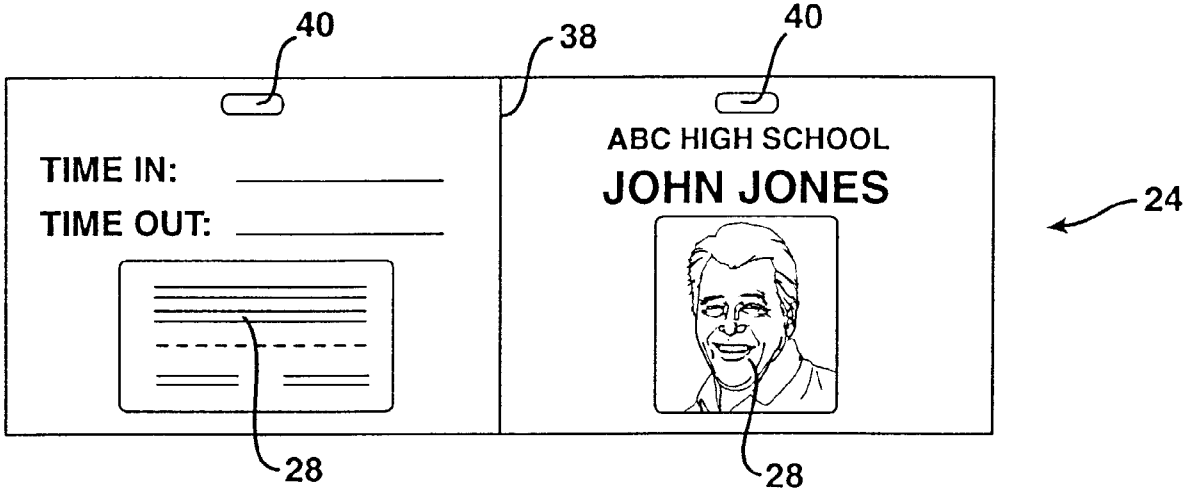
FIG. 15 depicts the printed side of another embodiment of an employee identification card badge of this invention right after printing and prior to assembly.
Figure 16:
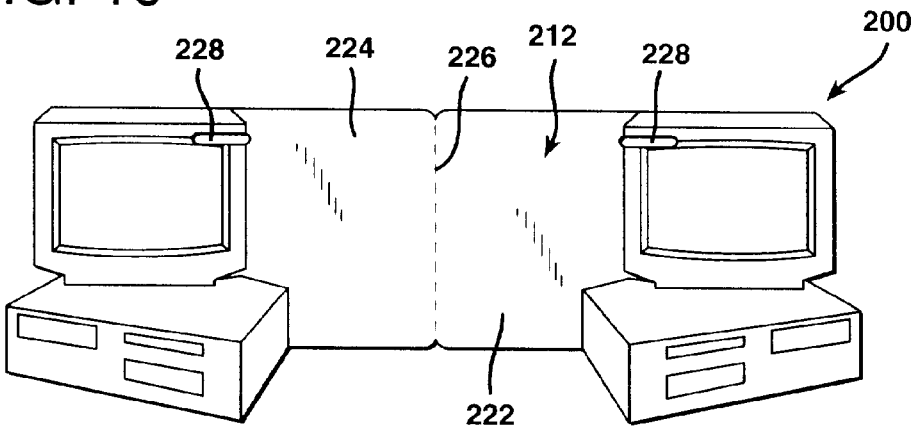
FIG. 16 depicts the printed side of another embodiment of the identification card of this invention after removal from the support strip and prior to being folded along the fold line to form a decorative shape which is a computer monitor.

Optionally, as depicted in FIGS. 14–15, the identification card may have an indicia 28 that is printed and also have an indicia that could be produced by placing a business card (FIG. 14) or a photograph (FIG. 15) behind sheet 36 that has a cut-out therein, and when the sheets 34, 36 are folded and adhesively sealed to each other, the business card or photograph is sealed between the sheets 34, 36 and can be viewed through the cut-out.

The identification cards produced from the strip assemblies of this invention have many other uses. For example, the identification cards may be used for retail tags, price tags, inventory tags. In all cases, the construction is similar to that described herein with the only variation being the size and shape of the card, and the location of the attachment hole.

Figure 24:
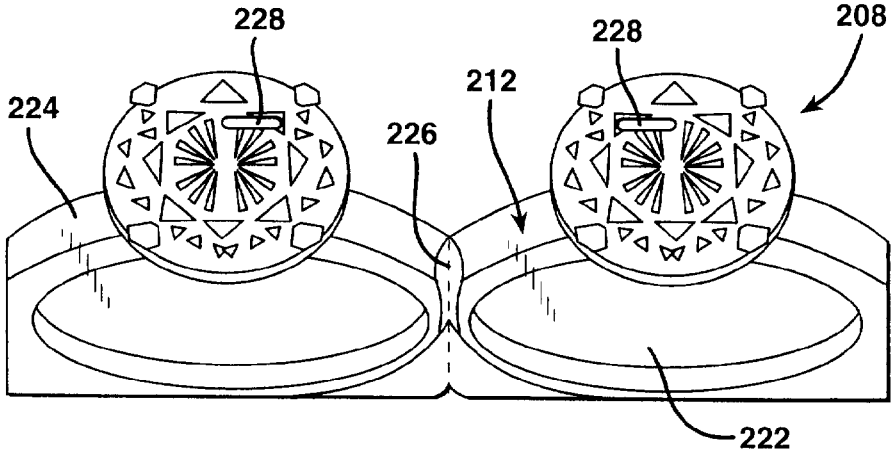

In other embodiments of this invention, as depicted in FIGS. 16–25, each card blank is defined by continuous slits in the sheet to form a card blank having a predetermined shape that is symmetrical about the fold line. When the card blank is removed from the support strip and the sheets are folded along the fold line upon each other, the identification card forms a decorative shape, generally a non-rectangular shape, such as a computer console (FIG. 16) a house (FIG. 17), an automobile (FIG. 18), a train (FIG. 19), a stuffed bear (FIG. 20), a shirt and tie (FIG. 21), a flag (FIG. 22), a police officer badge (FIG. 23) and a diamond ring (FIG. 24). Such decorative shapes can be relevant to the meeting or conference, e.g., houses for a real estate agent convention, trains for a model train club, etc.

Figure 17:
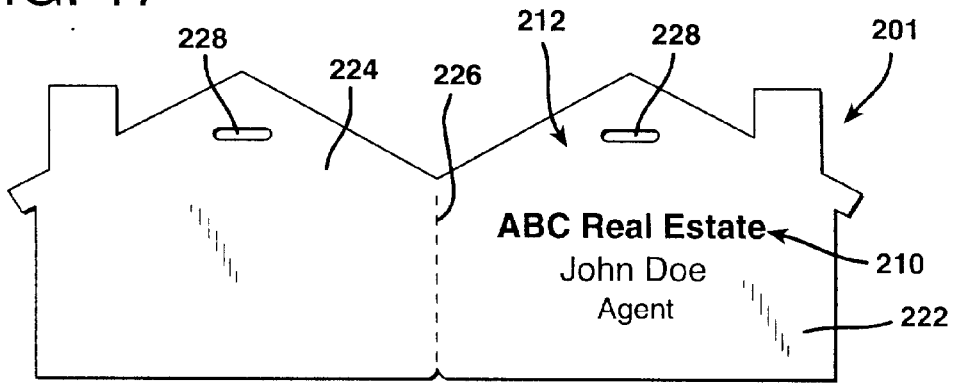
FIGS. 17–24 depicts the printed sides of still other embodiments of the identification card of this invention after removal from the support strip and prior to being folded along the fold line to form a decorative shape which is a house (FIG. 17), an automobile (FIG. 18), a train (FIG. 19), a stuffed bear (FIG. 20), a shirt and tie (FIG. 21), a flag (FIG. 22), a police officer badge (FIG. 23) and a diamond ring (FIG. 24)
Figure 18:
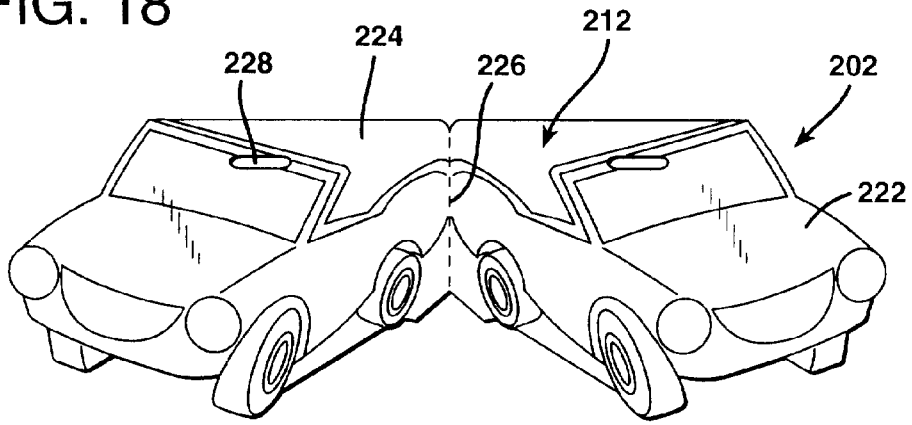
Figure 19:
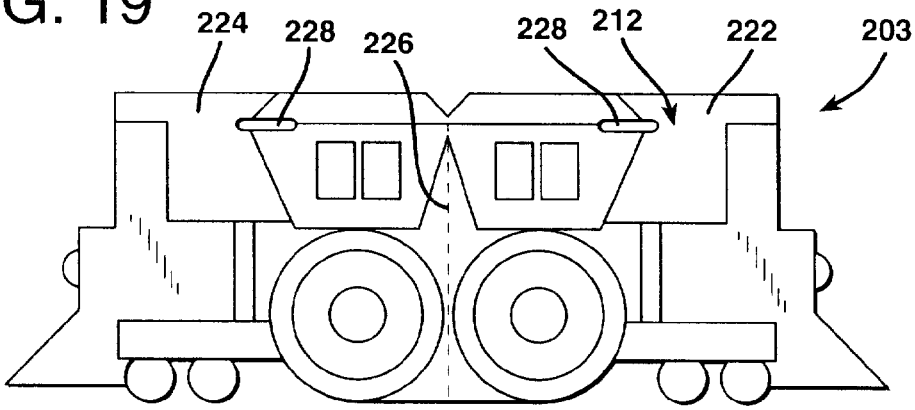
Figure 20:
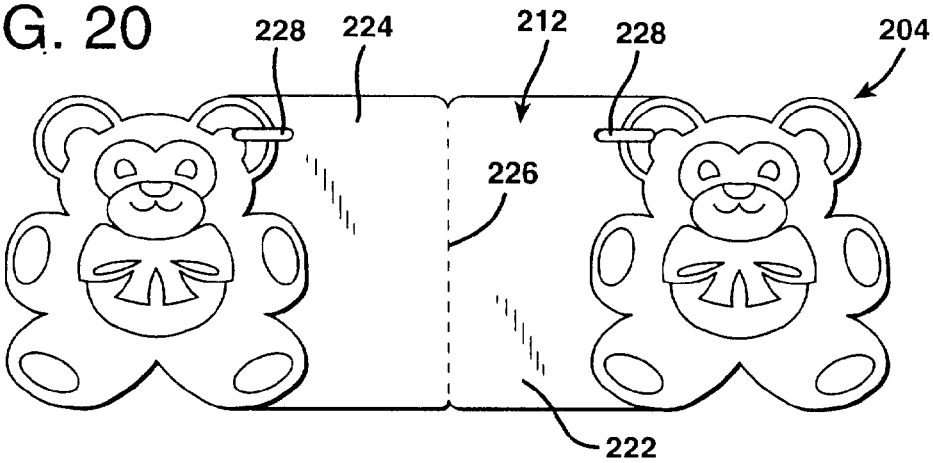
Figure 21:
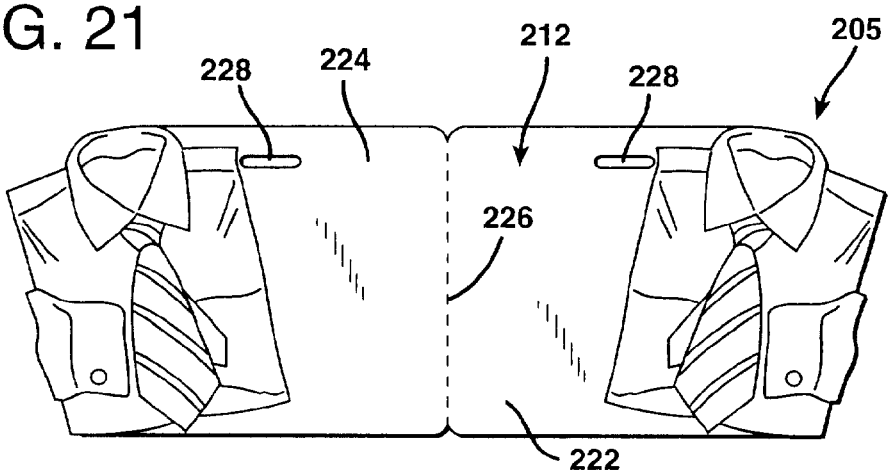
Figure 22:
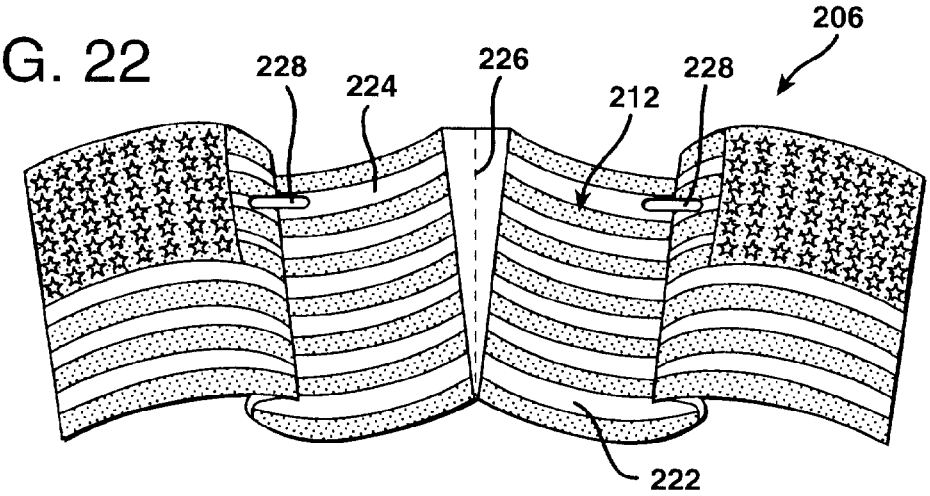
Figure 23:
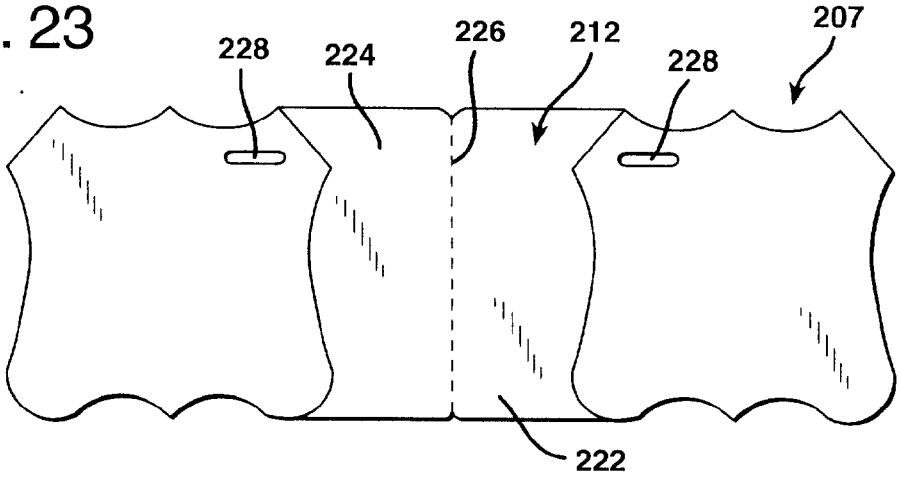
Figure 25:
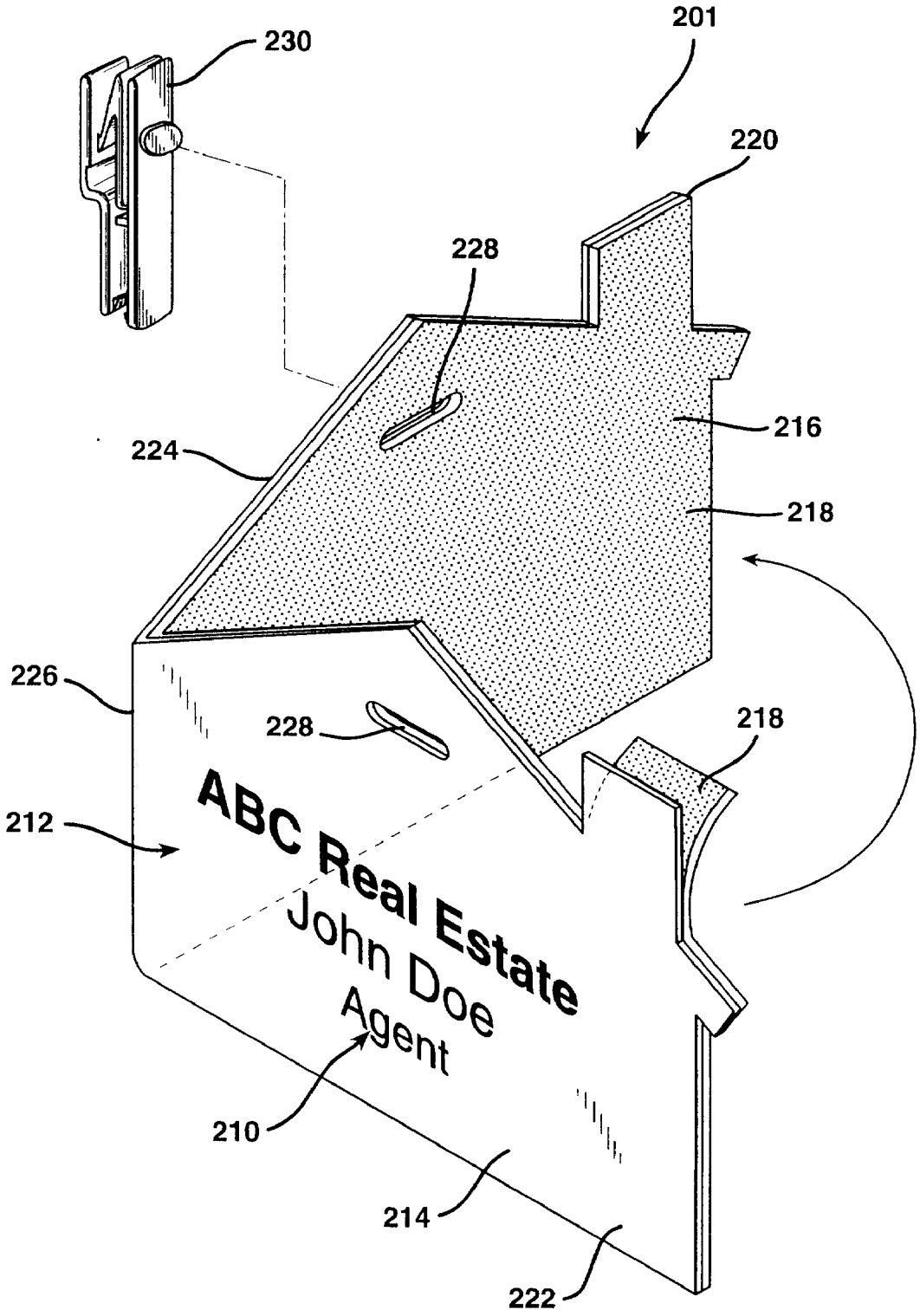
FIG. 25 is a schematic perspective indicating how the identification card of FIG. 17 may be assembled for use.

Referring to FIGS. 16–25, and in particular FIGS. 17 & 25, wherein identical numbers refer to the same or similar element, each identification card blank 212 has a front printing surface 214 for printing indicia 210 thereon, and a rear adhesive surface 216 having an adhesive 218 thereon. The rear adhesive surface 216 is removably and adhesively adhered to the support strip 220. The card blank 212 includes a first sheet 222 and a second sheet 224 foldably connected to each other along a fold line 226. Each sheet 222, 224 has at least one substantially identically shaped aperture therein 228. Each sheet 222, 224 is of a size and shape and each aperture 228 is located in each sheet 222,224 so that when the card blank 212 is removed from the support strip 220 and the sheets are folded along the fold line 226 upon each other with the adhesive surfaces 216 joined to each other, the first sheet 222 and second sheet 224 are substantially superimposed upon each other and substantially coextensive with each other and the apertures 228 in each sheet 222,224 overlay each other to form a mounting means for mounting the card 212 on an object. Preferably, as depicted in FIGS. 16–25, the identification cards 200–208 are uniquely and symmetrically shaped about the fold line 226 so that when the card blank 212 is removed from the support strip 220 and the sheets 222,224 are folded along the fold line 226 upon each other with the adhesive surfaces 216 joined to each other, the unique shapes are substantially superimposed upon each other and substantially coextensive to form a predetermined non-rectangular configuration, e.g., computer monitor, house, automobile, etc. that is relevant, for example, to the conference or meeting. Preferably, as for example depicted in FIG. 16, the assembled identification card 201 (or as the case may be 200–208) is mounted on a spring badge clip 230. The shaped badges 200–208 are stamped from a flat a support strip that is sufficiently flexible to pass through a laser printer.

While several advantageous embodiments have been chosen to illustrate the invention, it will be understood by those skilled in the art that various changes and modifications can be made therein without departing from the scope of the invention as defined in the appended claims.

What is claimed is:

1. An identification card strip assembly comprising:

a support strip and at least one identification card blank overlaying and removably and adhesively adhered to the support strip to form a card strip assembly, the assembly being sufficiently flexible to pass through a laser printer;

each identification card blank comprising:

a front printing surface for printing indicia thereon and a rear adhesive surface having an adhesive thereon completely covering the rear surface, the rear adhesive surface being removably and adhesively adhered to the support strip, the adhesive remaining on each card blank after being removed from the support strip;

the card blank including a first sheet and a second sheet foldably connected to each other along a fold line;

each sheet having at least one substantially identically shaped aperture therein;

each sheet being of a size and shape and each aperture located in each sheet so that when the card blank is removed from the support strip and the sheets are folded along the fold line upon each other with the adhesive surfaces joined to each other, the first sheet and second sheets are substantially superimposed upon each other and substantially coextensive with each other and the apertures in each sheet overlay each other to form a mounting means for mounting the card on an object.

2. An identification card strip assembly comprising:

an elongated support strip and a plurality of identification card blanks removably and adhesively adhered to the support strip to form a card strip assembly, the assembly being sufficiently flexible to pass through a laser printer;

each identification card blank comprising:

a front printing surface for printing indicia thereon and a rear adhesive surface having an adhesive thereon completely covering the rear surface, the rear adhesive surface being removably and adhesively adhered to the support strip, the adhesive remaining on each card blank after being removed from the support strip;

the card blank including a first sheet and a second sheet foldably connected to each other along a fold line;

each sheet having at least one substantially identically shaped aperture area therein in the shape of an aperture, the aperture area being defined by a continuous slit in the sheet and being severable from the sheet along the slit;

each sheet being of a size and shape and each aperture area being located in each sheet so that when the card blank is removed from the support strip and the sheets are folded along the fold line upon each other with the adhesive surfaces joined to each other, the first sheet and second sheets and the aperture areas in each sheet are substantially superimposed upon each other and substantially coextensive, and the aperture areas when removed from the sheets by severing along the slits, form a mounting means for mounting the card on an object.

3. The identification card strip assembly of claim 2, wherein the plurality of card blanks are formed from a continuous sheet and defined by plurality of lateral slits extending across the sheet at substantially equal longitudinal intervals, the card blanks being severable from each other along the slits.

4. The identification card strip assembly of claim 2, wherein the plurality of card blanks are formed from a continuous sheet and defined by a plurality of lateral slits extending across the sheet at substantially equal longitudinal intervals and a plurality of longitudinal slits extending across the sheet at substantially equal lateral intervals, the card blanks being severable from each other along the slits.

5. The identification card strip assembly of claim 2, wherein the plurality of card blanks are formed from a continuous sheet, each card blank being defined by continuous slits in the sheet to form a card blank having a predetermined shape, the shape being symmetrical about the fold line, each card blank being removable and severable from the sheet, wherein when the card blank is removed from the support strip and the sheets are folded along the fold line upon each other, an identification card having a non-rectangular decorative shape is formed.

6. The identification card strip assembly of claim 1, wherein the support strip has pin holes along the longitudinal edges of the strip to permit driving of the strip through an associated printing device.

* * * * *